US006109578A

United States Patent [19]

Guthrie et al.

[11] Patent Number: 6,109,578

[45] Date of Patent: Aug. 29, 2000

[54] BOREHOLE-ENGAGING APPARATUS

[76] Inventors: Karl Guthrie, 4650 Oak Glen Way, Fair Oaks, Calif. 95628; Joseph Schwartz, P.O. Box 2587, Wimberly, Tex. 78676

[21] Appl. No.: 09/132,005

[22] Filed: Aug. 10, 1998

[51] Int. Cl.[7] ..... A47F 5/08

[52] U.S. Cl. ..... 248/231.9; 248/323; 248/925; 411/75; 411/80

[58] Field of Search ..... 248/925, 231.9, 248/317, 323, 231.21; 411/75, 76, 78, 79, 80

[56] References Cited

U.S. PATENT DOCUMENTS

| | | | |
|---|---|---|---|
| 3,478,641 | 11/1969 | Dohmeier | 411/79 |
| 3,903,785 | 9/1975 | Pepper . | |
| 3,957,237 | 5/1976 | Campbell . | |
| 4,082,241 | 4/1978 | Burkey . | |
| 4,184,657 | 1/1980 | Jardine . | |
| 4,422,607 | 12/1983 | Vallance . | |
| 4,464,076 | 8/1984 | Leibhard . | |
| 4,572,464 | 2/1986 | Phillips . | |
| 4,607,992 | 8/1986 | Mauritz . | |
| 4,611,963 | 9/1986 | Frohlich . | |
| 4,643,378 | 2/1987 | Guthrie et al. | 248/925 |
| 4,715,568 | 12/1987 | Best . | |
| 4,818,163 | 4/1989 | Bereiter . | |
| 4,834,327 | 5/1989 | Byrne . | |
| 4,869,342 | 9/1989 | Borst . | |
| 5,042,888 | 8/1991 | Shinjo . | |
| 5,253,964 | 10/1993 | Swemmer . | |
| 5,484,132 | 1/1996 | George . | |

FOREIGN PATENT DOCUMENTS

| | | | |
|---|---|---|---|
| 2553-668 | 4/1985 | France | 248/925 |
| 2 191 710 | 12/1987 | United Kingdom | 248/925 |

OTHER PUBLICATIONS

Harsh Realm Solutions, LLC, Redmond, WA; Rebolts (tm) Removable.

Expansion Bolts; Climbing Magazine May 1–Jun. 15, 1997, p. 159.

*Primary Examiner*—Ramon O. Ramirez
*Assistant Examiner*—Walter Landry
*Attorney, Agent, or Firm*—Joseph E. Gerber

[57] ABSTRACT

The apparatus is for engaging a generally cylindrical borehole, and includes first and second chock portions, the first chock portion being generally spherical, the second being a trough-shaped wedge. The wedge-shaped second chock portion has a thinner end and a thicker end, and first and second primary surfaces. The first primary surface is cylindrically convex and dimensioned to seat flush against the wall of the borehole. The second primary surface is shaped as a concave, inclined trough dimensioned to permit the spherical first chock portion to slide freely therewithin. A primary tether affixed to the first chock portion is used to position the apparatus in the borehole, and includes a loop from which a user's body weight or gear may be suspended. A chock control cable operable with a finger pull bar is affixed to and operable to move the second chock portion in the borehole, lateral to the first chock portion. Sheaths protect and separate the primary tether and the chock control cable from one another. A flattened belt on the outermost surface of the first chock portion aids engagement with the borehole surface. A flattened belt on the first chock portion's inner surface aids engagement with the trough of the second chock portion.

20 Claims, 9 Drawing Sheets

BOREHOLE-ENGAGING APPARATUS

BACKGROUND OF THE INVENTION

1. Field of the Invention

The present invention relates generally to anchoring apparatus, and more specifically to apparatus able to be selectively engaged with, and disengaged and withdrawn from, a borehole having a generally uniform circular cross-section.

2. Description of the Related Art

Those who participate in the sport of rock climbing on sheer rock faces rely on safety ropes and various other apparatus to protect them against falls, and to support and move their climbing gear along with them as they climb. Traditionally, permanently-emplaced anchoring apparatus such as pitons and rock bolts have been used for transitory attachment of ropes, carabiners, webbing straps and other support apparatus to the rock face. Conventional pitons comprise a rigid spike with a projecting rigid loop; they are simply pounded into a crack in the rock face with a hammer. Rock bolts may be any of a number of types of apparatus which fall into the general class of mechanical mechanisms commonly referred to as "expansion dowels." These are normally adapted to engage a pre-drilled borehole, and generally comprise a cylindrical, threaded or nonthreaded dowel body, and a distal expansion member adapted to spread radially in response to axial movement of the dowel body. The axial movement may be accomplished by torque as with a wrench, or by axially-directed force as with a hammer.

Pitons have fallen into disfavor because they project dangerously from the rock face; they rust, and can break off and leave more dangerous, sharp remnants; and, they stain and deface the natural rock face. Further, they are quite heavy when enough are carried to complete a substantial climb; they are difficult to recover once emplaced, thus being costly; and, they are dangerous for later climbers to rely upon, not knowing the age of the piton or the experience of the climber who placed it. Yet further, pitons cannot be used in all rock; some rock faces are highly erodible, or have few cracks or fissures for emplacement.

Rock bolts pose many of the same problems as pitons, although many styles of rock bolt are, theoretically, removable. Still, removal of a rock bolt requires unscrewing, prying, and often a significant amount of energy and one or more extra tools for the operation. Thus, rock bolts are generally undesirable, as well.

The sport of rock climbing is currently evolving due to pressure from the public to improve the aesthetics of rock faces used for recreational rock climbing. This is causing park lands management officials and others to order removal of, or at least to prohibit further placement of, such "fixed anchors" as pitons and rock bolts. Thus, even though fixed anchors are undesirable in many respects, climbers who continue to prefer to rely upon them can no longer find them in certain areas.

Simultaneously, over the past ten to fifteen years, or so, climbers have ventured away from climbing routes and sites where fixed anchors are already emplaced. This spurred development of various instantly-emplaceable and removable "chocks" and wedges for lodging in natural cracks and crevices in rock faces. The simplest of these are single-piece, wedge-shaped structures of various sizes, with variously-angled faces, having no moving parts. All have in common a secure, projecting loop to which a carabiner, rope or webbing strap may be secured. This loop is normally constructed of coated, flexible cable, and normally projects from the narrower or thinner end of the wedge-shaped body of the chock. Use is effected by simply forcing the chock into a crack and setting it in place by pulling on its projecting loop in the direction in which the chock will bear weight. However, simple, one-piece chocks have several drawbacks. One is that a great number of different shapes and sizes of chock are needed for different climbs. And, although theoretically removable, once a chock is set in a crack and has been used to bear weight, it is often very difficult to remove and retrieve for later use. Thus, a fair expense may mount in the course of a climb, simply from the loss of chocks which are too difficult to remove. Later climbers rely on such chocks left behind only at great risk, because their age and stability of placement are often difficult to discern. Such abandoned chocks stay in place and degrade, sometimes leaving dangerous, projecting, frayed cable ends. U.S. Pat. No. 4,442,607 issued to Vallance in 1983 shows such a one-piece chock. Others are shown in U.S. Pat. No. 4,082,241 issued to Burkey in 1978, and U.S. Pat. No. 3,957,237 issued to Campbell in 1976.

Multi-piece chocks of various types have been developed to remedy some of the problems encountered in the use of single-piece chocks. Examples of these are shown in U.S. Pat. No. 3,903,785 issued to Pepper, Jr. in 1975; U.S. Pat. No. 4,572,464 issued to Phillips in 1986; and, U.S. Pat. No. 4,715,568 issued to Best in 1987. These devices generally include wedge-shaped subcomponents which are slidingly engaged with one another in a way which causes their combined effective width to increase as force is applied to a cable loop or lanyard in a direction away from the chock. Each such device is able to be used in a wider range of crack sizes than a single-piece chock, thus offering climbers greater weight-carrying economy. And, these are somewhat easier to remove from cracks than single-piece chocks because their machined, abutting faces slide easily over one another, and thus decrease the chock's effective width, in response to force directed opposite to the direction in which weight is borne. Nevertheless, a fair collection of sizes still needs to be carried and, when stuck, they tend to rust, rot and fray like any other chock.

Yet another class of climbing aids, commonly known as "Friends" (U.S. Pat. No. 4,184,657 issued to Jardine in 1980), includes devices having a central support bar and a cross-spindle, with two pairs of oppositely-rotating, gear-toothed cams residing on the spindle. Coil springs on the spindle bias the cams outward, and a pull-bar transverse to the central support and connected to the cams with cables is operable to retract the cams inward toward the central support. In use, such device is inserted in a crack with its cams retracted. When its cams are released, they abut opposing walls of the crack with the cross-spindle in an over-center position. Although "Friends" provide many advantages in certain situations, they have significant drawbacks, as well. These include mechanical complexity, considerable expense, the tendency to "walk" into cracks and become irretrievable.

In light of the mechanical drawbacks and the aesthetic and safety problems caused by the aforedescribed devices, it appears worthwhile to seek a new approach to rock climbing which provides maximum safety against disengagement from the rock; minimizes the amount of gear needed to be carried; minimizes gear loss from irretrievable emplacements; preserves the aesthetics of the rock face; and, utilizes existing alterations to the rock face to the best advantage.

SUMMARY OF THE INVENTION

The borehole-engaging apparatus of the present invention is adapted to overcome the above-noted shortcomings and to fulfill the stated needs. Indeed, this inventive apparatus makes possible the needed, new approach to rock climbing. Drilled holes are already plentiful, and more become available as old hardware is removed from rock faces. Drilling new holes on new routes is minimally destructive; boreholes are aesthetically practically invisible, even with age; and, they provide a nearly failure-proof, standardized way of securely binding climbers and their equipment to rock faces.

The borehole-engaging apparatus of the invention includes first and second chock portions, the first being generally spherical and the second being wedge-shaped. The surface of the second chock portion includes a longitudinal channel, and means are provided for moving the first chock portion axially, lateral to the second chock portion. As the spherical first chock portion travels along the channel of the wedge-shaped second chock portion, toward the borehole's open end, the spherical chock portion cams against the wall of the borehole.

It is an object of the present invention to provide apparatus able to engage, securely yet easily releasably, a pre-drilled borehole in a solid surface.

Another object of the invention is to provide climbing anchor apparatus which is simple in construction, yet reliable in operation.

It is a further object of the present invention to provide rock climbing apparatus able to be manufactured in one or a few standard sizes, thus reducing cost per unit and the amount of gear a climber must purchase and carry.

Yet another object of this invention is to provide apparatus able to be engaged with a surface feature in a climbing surface in nearly any rotational orientation about the apparatus' longitudinal axis.

And, it is also an object of the present invention to provide climbing surface-engaging apparatus which does not depend on engagement with the irregular and unreliable surfaces of cracks, holes, pockets, seams and fissures in a rock face.

Yet a further object of the present invention is to provide borehole-engaging apparatus able to be engaged with boreholes in rock, as well as in other solid materials such as metal, concrete and wood, with similar ease and security.

Still a further object of the present invention is to provide climbing surface-engaging apparatus which, after using a drill to create a borehole on a first ascent, requires no additional tools such as hammers or wrenches for emplacement, or pry bars for release.

Another object of the present invention is to provide climbing surface-engaging apparatus not prone to creep, shift in, or walk into the surface feature with which it is engaged.

Still further objects of the inventive borehole-engaging apparatus disclosed herein will be apparent from the drawings and following detailed description thereof.

DESCRIPTION OF THE PREFERRED EMBODIMENT

Figure 1:
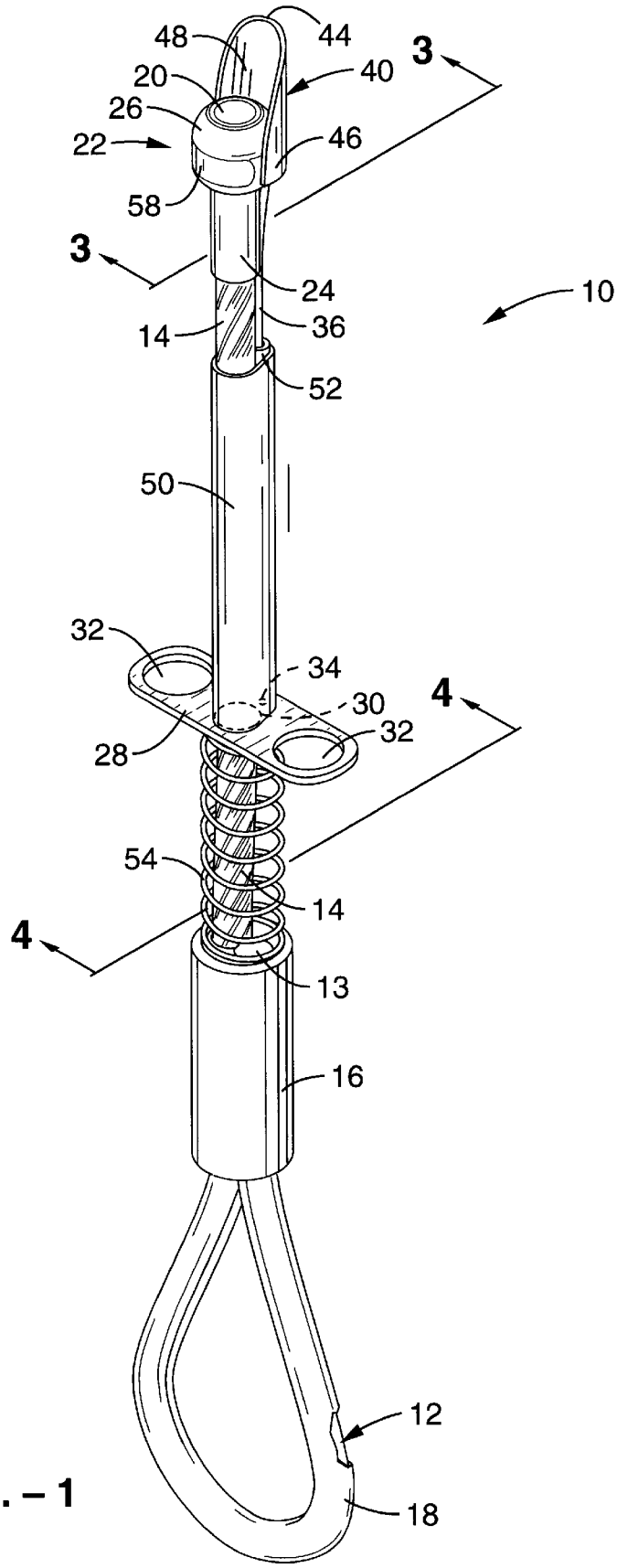
FIG. 1 is a perspective view of the borehole-engaging apparatus of the invention.
Figure 2:
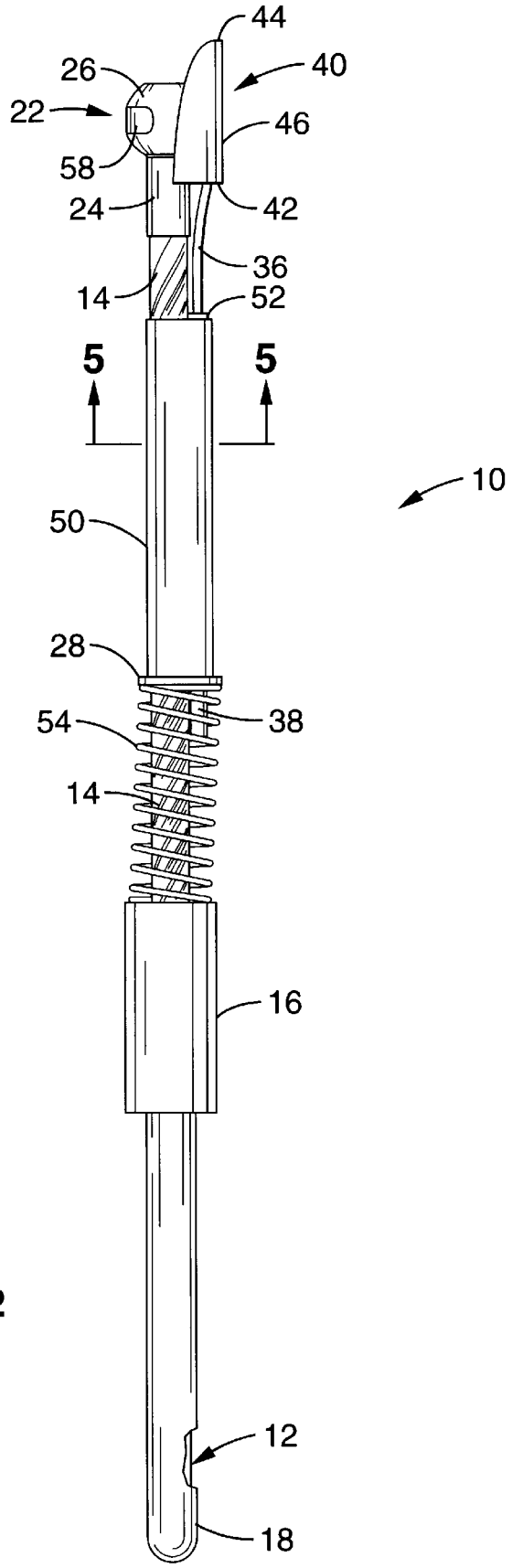
FIG. 2 is a side elevational view of the borehole-engaging apparatus of FIG. 1.

Referring now specifically to the drawings, FIGS. 1 through 5 show the construction of the inventive borehole-engaging apparatus, which is generally identified herein with the reference numeral 10.

The primary structural member of apparatus 10 is a thick, flexible length of cable formed into a proximal loop portion 12 and a distally-projecting tether portion 14.

For consistency in orientation herein, the directional convention established above will be continued here and in the claims. Thus, elements located nearer to that end of apparatus 10 where loop 12 is located will be referred to as proximal, as they are closer to the user. Conversely, elements located nearer to the opposing, terminal end of distally-projecting tether 14 will be referred to as distal. And, the same convention will be used to refer to the directional movement of elements. Thus, movements in a proximal direction will be understood to be toward loop 12 and the user, and movements referred to as distally-directed will be understood to be in the direction of tether 14's terminus, and therebeyond.

The cable stock employed in loop 12 and tether 14 is preferably comprised of multi-stranded, twisted steel. The diameter and break strength of the cable used may vary in different versions of apparatus 10, depending on the intended use. For example, in "aid climbing" where rope ladders are used to travel only four feet or less at a time, climbers risk only very short falls. Thus for "aid climbing," cables of one-quarter inch, or less may be satisfactory. In contrast, for "free climbing" where much longer fall potentials exist, cables of three-eighths inch to one-half inch will be preferred.

Further, the preferred cable should have a somewhat resilient character in lengths such as are used in the construction of borehole-engaging apparatus 10, such that when a length of such cable is bent or otherwise deformed, it tends to spring back to a generally linear configuration. However, other types of cable and wire rope of twisted, woven, braided or even mono-stranded construction, and of different materials, may be satisfactory in practicing the invention as long as they meet the specifications generally known in the art to be required for the intended purposes. Even solid, rigid stock may be satisfactory or preferred in some instances.

Loop 12 is comprised of a free cable end 13 turned back and laid against a midportion of the cable, secured in place with cable clamp 16. Clamp 16 is preferably a generally cylindrical collar of deformable metal, swaged in place in any of a number of ways known in the art. However, other types of clamps employing mating portions secured with screws and other such fasteners may also suffice. In any case, once properly in place, clamp 16 must be of such secure engagement as to prevent failure of loop 12 under a load at least equal to the break-strength rating of the cable of tether 14.

Loop 12 is preferably covered with a flexible, durable, smooth-surfaced sheath 18. Sheath 18 prevents damage to the strands of the cable of which loop 12 is comprised; prevents abrasion of other climbing apparatus by the cable; and, makes borehole-engaging apparatus 10 comfortable for the user to handle. Sheath 18 is preferably constructed of tubular flexible plastic stock. However, other constructions and materials may also work satisfactorily. Tubular rubber sleeves may be an option but, if used, would preferably include a low-friction surface. Various types of dipped plastic or rubberized coatings might also work satisfactorily.

Figure 3:
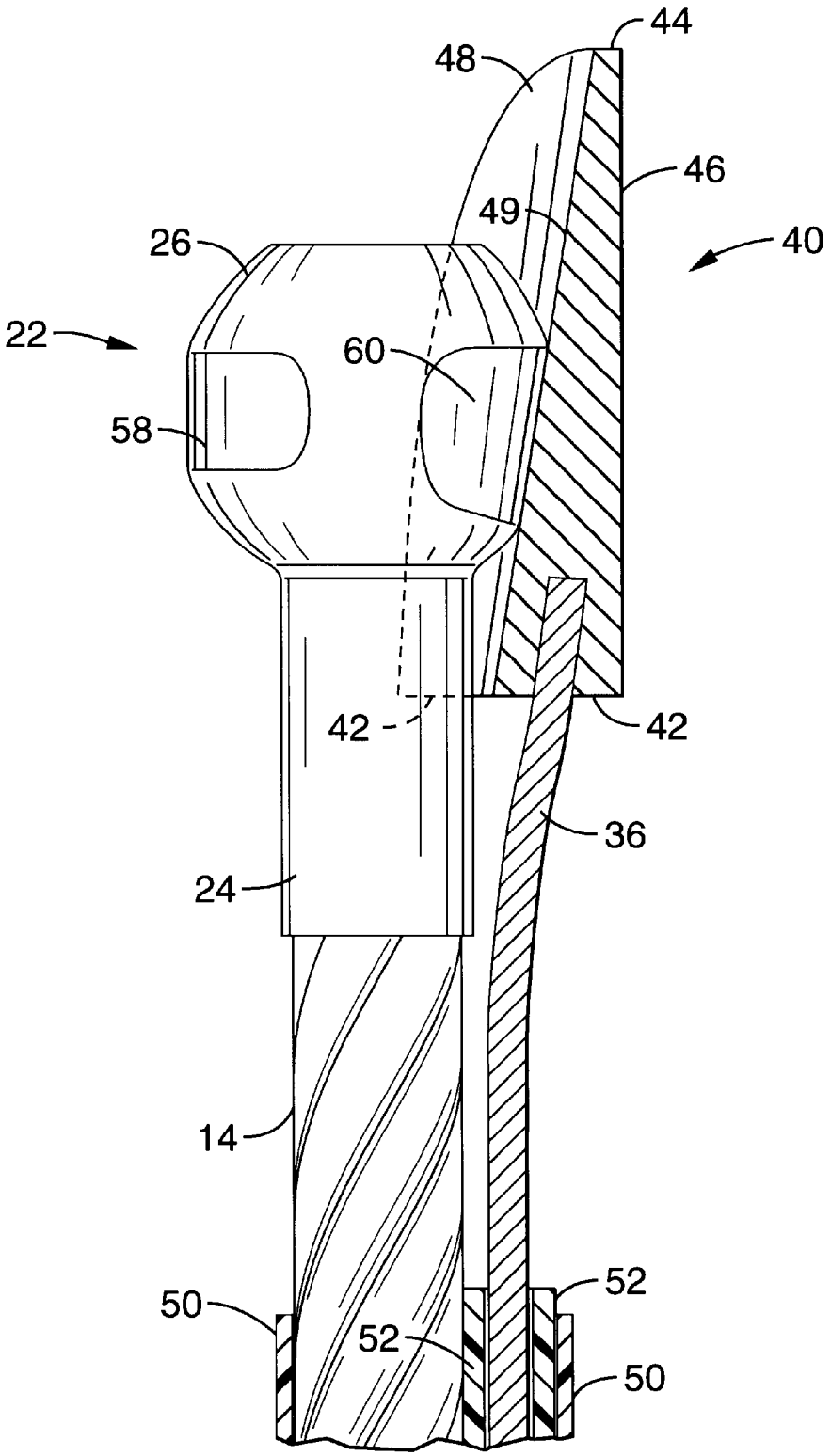
FIG. 3 is an enlarged, partially cross-sectional view of the distal end of the borehole-engaging apparatus of the invention of FIG. 1, taken on line 3—3 thereof, showing the generally spherically-shaped ball chock portion and the wedge-shaped cam chock portion.

Tether 14 is integral with and is an extension of the cable stock that makes up loop 12. Tether 14 projects several inches beyond cable clamp 16. The distal terminus 20 of tether 14 is fitted with ball chock 22 which is comprised of a swaged steel ball shank end. As best seen in FIG. 3, ball chock 22 includes a more proximal, generally cylindrical collar 24 and an integral, terminal ball end 26 distal to collar 24. Ball chock 22 also includes an axial channel therethrough which receives tether 14. It is essential that ball chock 22 be swaged and secured sufficiently well to tether 14 to assure that the connection therebetween will endure a load at least equal to the break-strength rating of the cable of which loop 12 and tether 14 are constructed.

Although a simple swaged ball affixed to the terminus of tether 14 might, at first, seem a satisfactory substitution for the preferred "ball shank" end shown here, swaged balls without projecting shanks are considerably weaker than the preferred unitary ball shank disclosed herein. Ball shanks, when properly applied, are able to be swaged to a cable end sufficiently securely to bear the full break-strength of the cable. Simple swaged balls, in contrast, may fail at only 60–80% of the cable's break-strength. Nevertheless, substitute types of ball ends and other cable end structures known to those in the art to be capable of attachment to a cable end sufficiently securely to equal at least the full break-strength of the cable may also be satisfactory.

Finger pull bar 28 is a rigid, planar, generally rectangular length of metal stock with four apertures therethrough. A first of these is large central aperture 30 through which the mid-length of tether 14 passes in slidingly unencumbered fashion. Thus, pull bar 28 is mounted in a orientation on tether 14 such that finger pull bar 28's length is generally perpendicular to the longitudinal axis of borehole-engaging apparatus 10, and such that the planes of the broad faces of finger pull bar 28 are also perpendicular to the longitudinal axis of borehole-engaging apparatus 10. This is best viewed in FIG. 4.

The second and third apertures in finger pull bar 28 are end apertures 32, both having the same reference numeral in the drawing figures. Each end aperture 32 is the same short distance from its respective end of finger pull bar 28 as the other. End apertures 32 are preferably generally circular and of a size sufficient to permit easy location thereof by the user with the touch of his or her fingertips. End apertures 32 are best viewed in FIG. 1.

Figure 4:
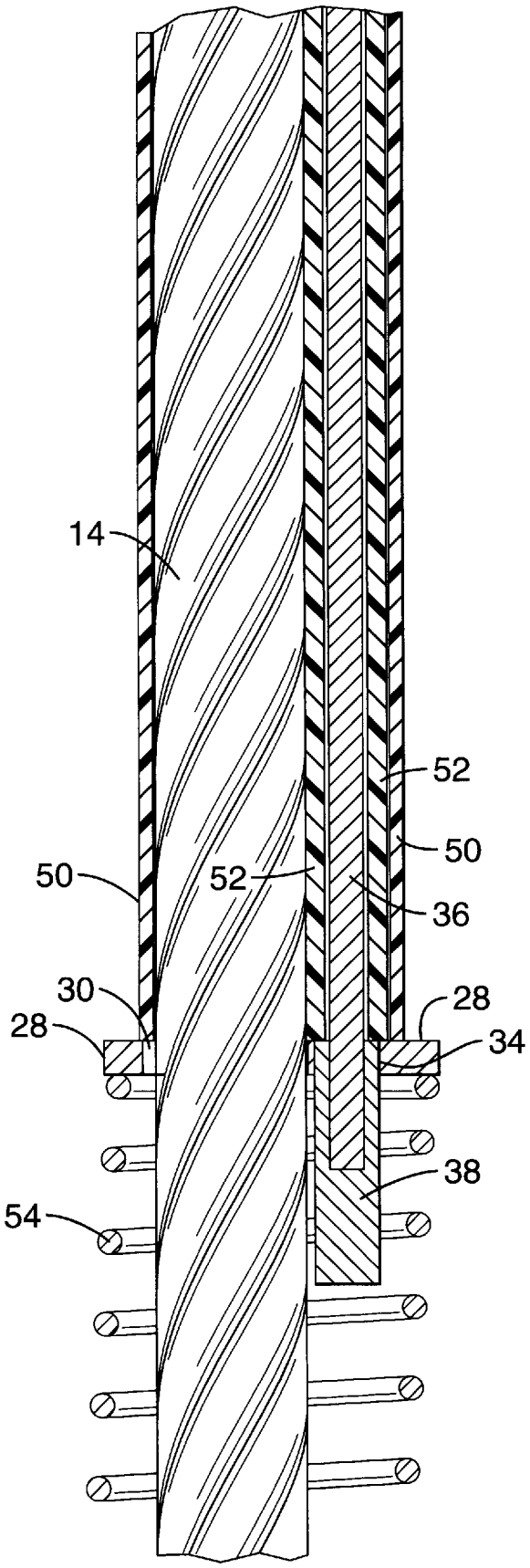
FIG. 4 is an enlarged, partially cross-sectional view of the mid-length portion of the borehole-engaging apparatus of the invention of FIG. 1, taken on line 4—4 thereof, showing the cables, sheaths and coil spring thereof.

The fourth aperture in finger pull bar 28 is small central aperture 34, disposed laterally adjacent to large central aperture 30 in finger pull bar 28. That is, large central aperture 30 and small central aperture 34 are both equidistant from the opposed ends of elongate finger pull bar 28. This is best indicated in FIG. 4. Small central aperture 34 receives the proximal end of chock operator cable 36. Cable end anchor 38 is a formable, swaged cable end which binds the proximal end of chock operator cable 36 into small central aperture 34, thus tying chock operator cable 36 securely and rigidly to finger pull bar 28. Thus, as finger pull bar 28 is moved slidingly to and fro axially along tether 14, chock operator cable 36 moves axially and equivalently, parallel to tether 14.

Figure 6:
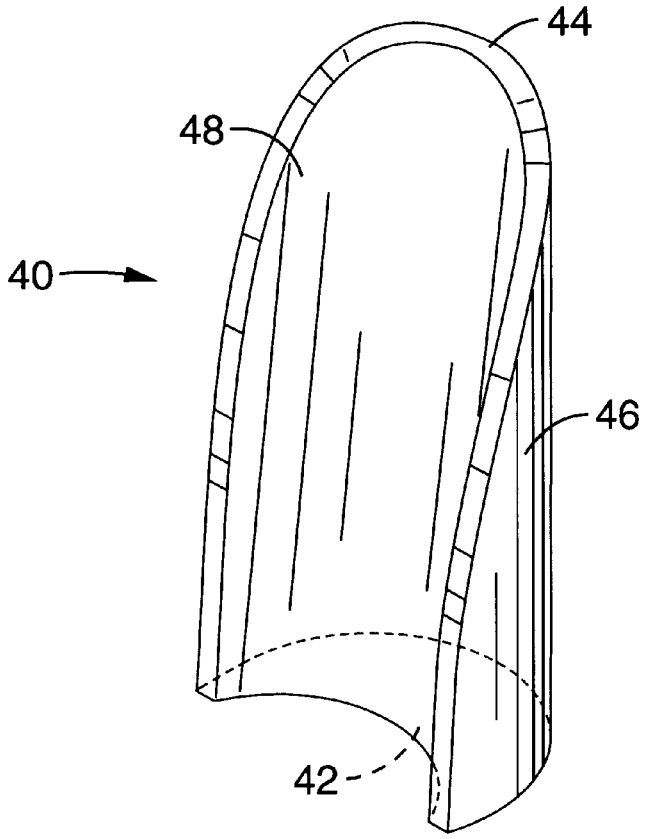
FIG. 6 is a perspective view of the cam chock portion of the inventive borehole-engaging apparatus.
Figure 7:
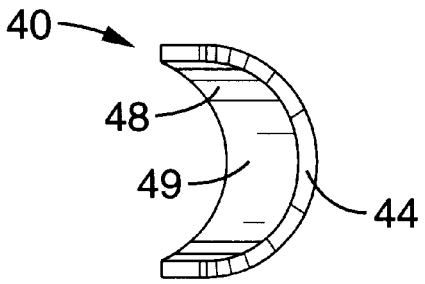
FIG. 7 is a distal end view of the cam chock portion of the apparatus.
Figure 8:
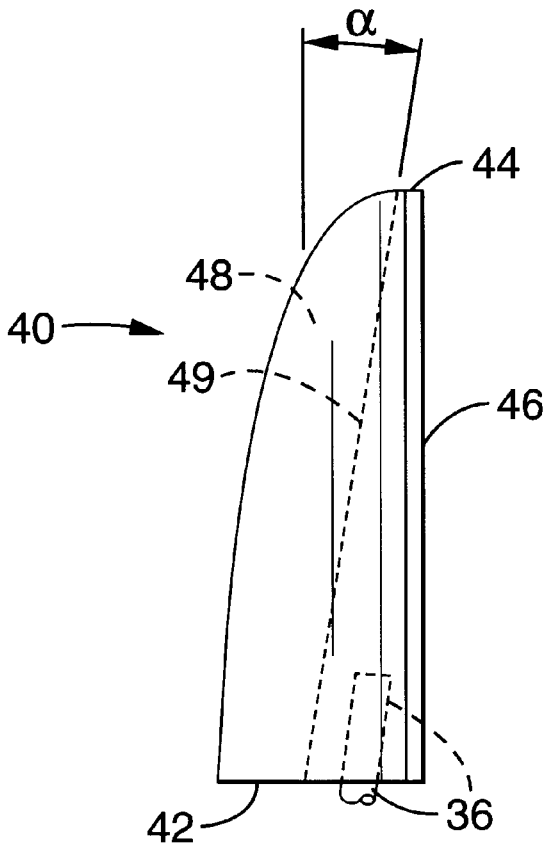
FIG. 8 is a side elevation view of the cam chock portion, showing that the longitudinal axes of the cylindrical inner and outer primary surfaces of the cam chock are disposed at an angle $\alpha$ to one another.
Figure 9:
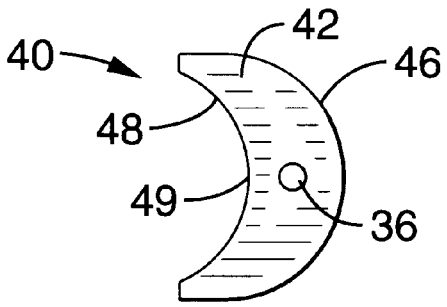
FIG. 9 is a proximal end view of the cam chock portion of the apparatus.

Wedge-shaped cam chock 40 is constructed of steel, and is swaged to the distal end of chock operator cable 36. Cam chock 40 has a complex shape, best understood by reference to FIGS. 3, 6, 7, 8 and 9. Cam chock 40 is thicker at its proximal end and thinner at its distal end. Proximal end face 42 of cam chock 40 is generally semicircular as shown in FIG. 9, and disposed in a plane perpendicular to the longitudinal axis of borehole-engaging apparatus 10. Leading, distal end edge 44 of cam chock 40 is crescent-shaped when viewed end-on, as in FIG. 7. However, from a perspective view, as shown in FIGS. 1 and 6, cam chock 40—and especially cam chock 40's distal portion—can be seen to be shaped roughly like a shovel or a scoop.

Cam chock 40 has an outer primary surface 46 which is cylindrically convex and dimensioned to seat flush against the wall of a linear borehole of generally uniform diameter. The inner primary surface 48 of cam chock 40 is a longitudinal channel shaped as an inclined, cylindrically-concave trough. The radius of the trough of inner primary surface 48 is uniform throughout the trough's length and, of course, smaller than the radius of outer primary surface 46. The radius of the trough of inner primary surface 48 is preferably approximately the same as the radius of ball chock 22.

In order to achieve the optimal slope in the trough of inner primary surface 48 with respect to outer primary surface 46, thus giving cam chock 40 a wedge shape, the longitudinal axes of the cylindrical inner and outer primary surfaces 48 and 46 are preferably disposed at approximately 8 to 9 degrees to one another. These axes are coplanar in the plane which bisects the symmetrical halves of cam chock 40; they converge toward the thinner, distal end edge 44 of cam chock 40, and diverge toward the thicker, proximal end face 42 of cam chock 40. The slope of the central floor 49 of the trough of inner primary surface 48 is best shown in the cross-sectional views of FIGS. 3 and 8. FIG. 8 shows the difference in angle $\alpha$ between the axes of the cylindrical inner and outer surfaces 48 and 46 of cam chock 40. Notwithstanding the preferred 8 to 9-degree difference in the angles of the axes, angles between 7 and 12 degrees are expected to work generally satisfactorily in practicing the invention. And, it is further contemplated that angles from 3 to 20 degrees, or so, may work in principle. Even greater and/or smaller angles may work satisfactorily or be preferable for certain purposes. And, it is contemplated that different materials of construction may be employed to achieve or maximize the mechanical effect of such greater or smaller angles.

Large diameter sheath 50 wraps around and covers most of tether 14 between finger pull bar 28 and ball chock 22.

Figure 5:
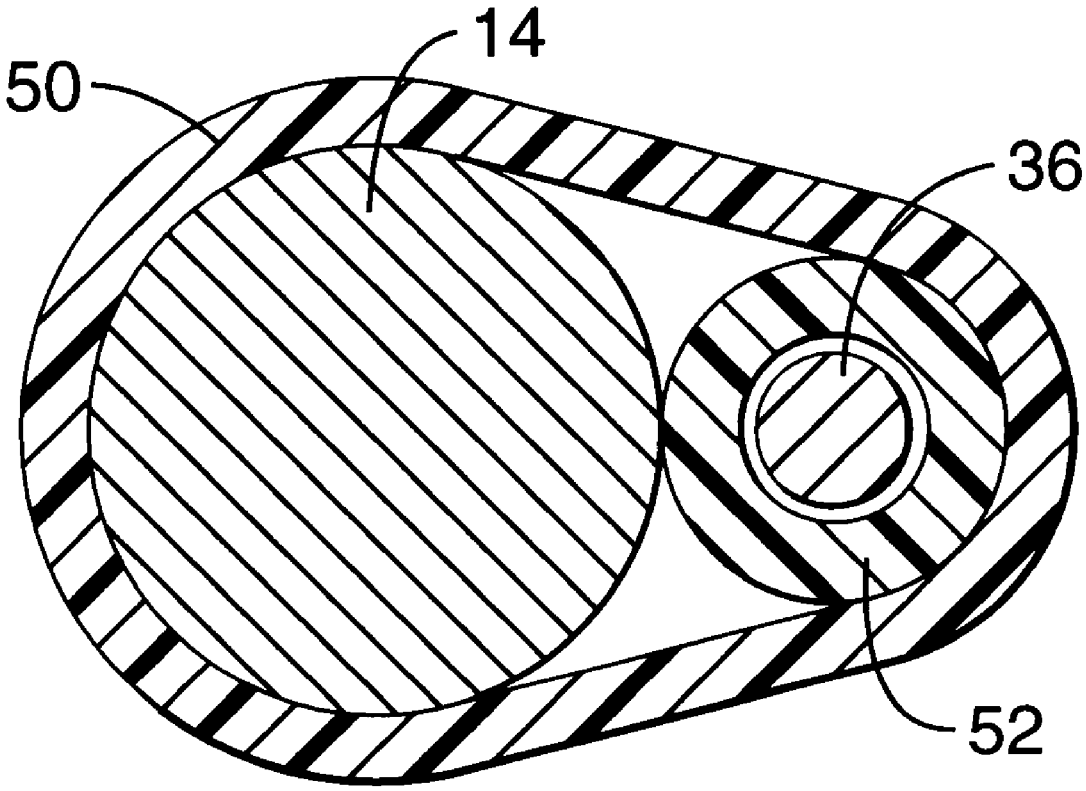
FIG. 5 is a cross-sectional view of the borehole-engaging apparatus of FIG. 2 taken on line 5—5 thereof.

Large diameter sheath 50 is generally cylindrical and is preferably constructed of durable, flexible plastic. Large diameter sheath 50 has an inside diameter somewhat larger than the diameter of the cable of tether 14. The cross-section of large diameter sheath 50 is not completely circular because in addition to surrounding tether 14, large diameter sheath 50 also surrounds small diameter sheath 52, through which chock operator cable 36 passes. This is best shown in FIG. 5. Large diameter sheath 50 and small diameter sheath 52 are approximately the same length, and are disposed parallel to one another. Small diameter sheath 52 is preferably constructed of durable, flexible plastic, and has an inside diameter slightly larger than the diameter of chock operator cable 36. Small diameter sheath 52 has a circular cross-section throughout its length. Chock operator cable 36 is able to pass freely and slidingly to and fro through small diameter sheath 52. Both large diameter sheath 50 and small diameter sheath 52 are fixed in place in relation to one another, and in relation tether 14. Tether 14 does not slide with respect to large diameter sheath 50, or with respect to small diameter sheath 52. As chock operator cable 36 passes to and fro through small diameter sheath 52, tether 14, large diameter sheath 50 and small diameter sheath 52 retain their positions. This is best achieved by constructing large diameter sheath 50 of a material which can be shrunk around tether 14 and small diameter sheath 52, thus binding them tightly to one another.

Moving finger pull bar 28 to and fro axially slides chock control cable 36 through small diameter sheath 52. This, in turn, moves cam chock 40 to and fro axially and, simultaneously, laterally past ball chock 22.

Cam chock 40 is biased toward a more distal position lateral to ball chock 22 by coil spring 54. Coil spring 54 is coaxial with the more proximal portion of tether 14, and is disposed between the distal end of cable clamp 16 and the proximal face of finger pull bar 28. When coil spring 54 is fully extended and uncompressed, the thicker, proximal portion of cam chock 40 should reside directly lateral to ball chock 40. Drawing finger pull bar 28 in a proximal direction, thus compressing coil spring 54, should cause cam chock 40's thinner, distal edge 44 to reside directly lateral to ball chock 40.

The dimensions of ball chock 22 and cam chock 40 with respect to the intended borehole in which they will be used should be as follows. With ball chock 22 nested slidingly in the trough of inner primary surface 48, and disposed adjacent cam chock 40's thicker, proximal end, the width, i.e. the diameter, of ball chock 22 combined with the thickness of cam chock 40 should be greater than the borehole's diameter. This should be the case when coil spring 54 is fully extended and uncompressed, as shown in FIG. 1. Conversely, as finger pull bar 28 is drawn in the proximal direction to the point where thin, distal edge 44 of cam chock 40 lies laterally adjacent to ball chock 22, the diameter of ball chock 22 combined with the thickness of that portion of cam chock 40 should be slightly less than the borehole's diameter. Thus, somewhere in the mid-portion of ball chock 22's travel along the trough of inner primary surface 48, the combined width of ball chock 22 and the thickness of that portion of cam chock 40 which lies directly lateral to ball chock 22 should equal the intended borehole's diameter. This is best illustrated by reference to FIG. 10, which shows finger pull bar 28 drawn proximally, with the thinnest, distal-most portion of cam chock 40 lying directly lateral to ball chock 22.

Figure 10:
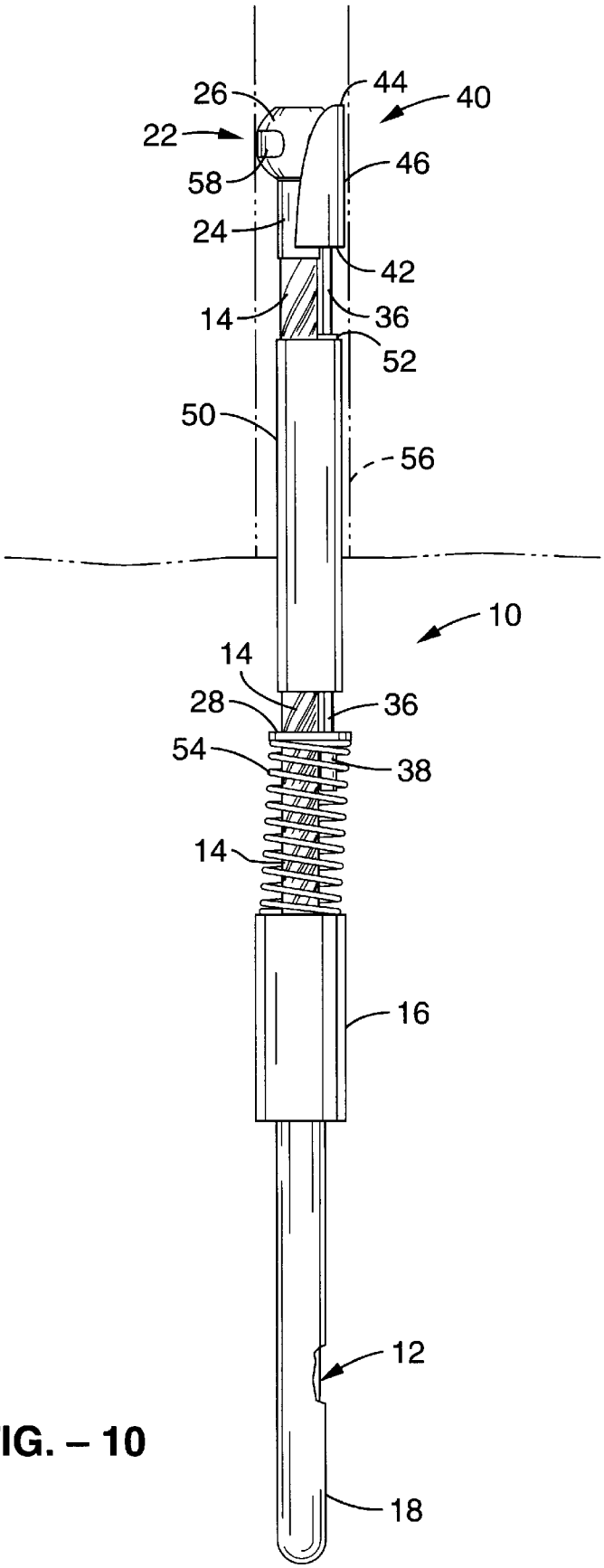
FIG. 10 is a side elevational view of the borehole-engaging apparatus being slidingly inserted into a borehole, showing the wedge-shaped cam chock portion drawn more proximally with reference to the ball chock portion.
Figure 11:
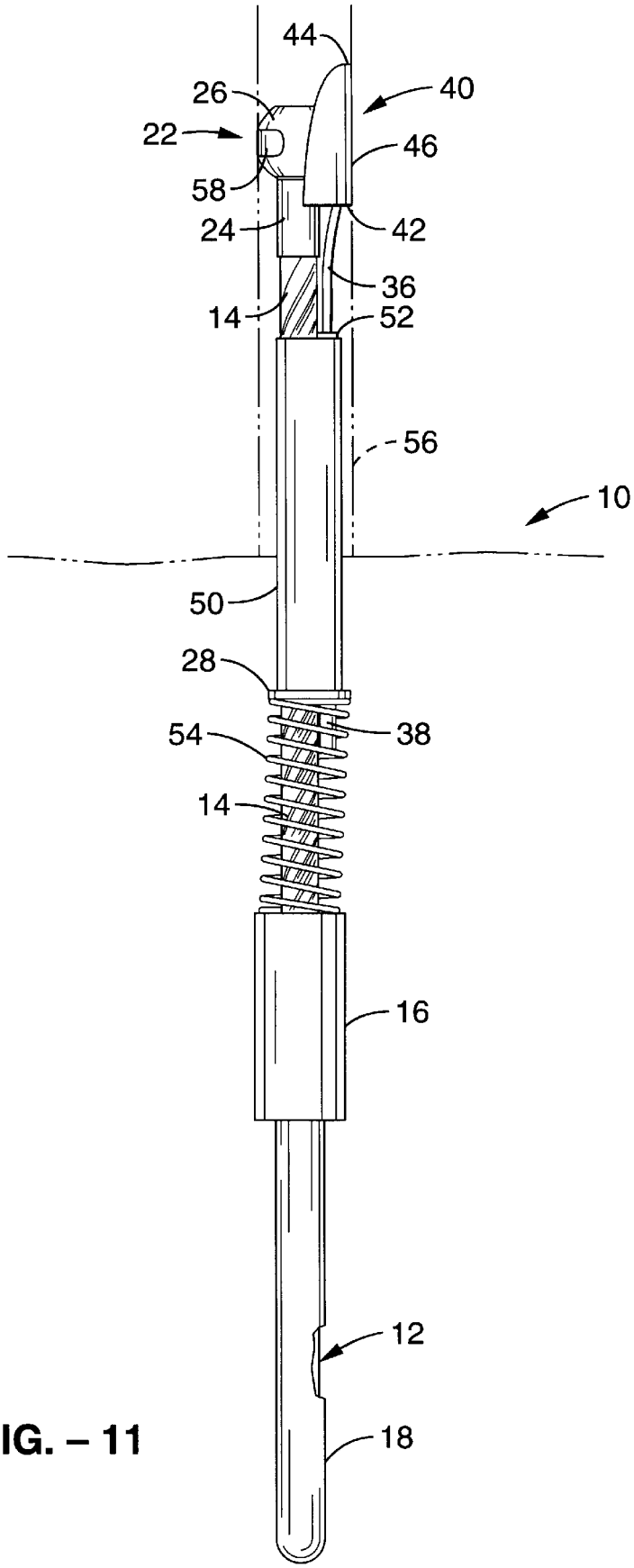
FIG. 11 is a side elevational view of the borehole-engaging apparatus being lodged into a borehole, showing the ball chock portion drawn proximally, camming the outer face of the cam chock portion against the wall of the borehole.

In use, insertion of apparatus 10 in borehole 56 requires the orientation and posture shown in FIG. 10. Then, upon release of finger pull bar 28 as shown in FIG. 11, and upon applying a proximally-directed tug upon loop 12, ball chock 22 moves slightly proximally along the trough of inner primary surface 48 of cam chock 40. This causes cam chock 22 to cam laterally toward the wall of borehole 56. As cylindrical outer primary surface 46 of cam chock 40 has roughly the same radius as borehole 56, a secure, frictional engagement is achieved between cam chock 40 and the wall of borehole 56. Ball chock 22 engages the opposing wall of borehole 56 at a very small point, exerting an increasing number of pounds per square inch of force thereagainst as proximally-directed force is applied to loop 12, pulling ball chock 22 proximally along cam chock 40's sloping trough. Indeed, with sufficient proximally-directed force applied to loop 12, welds can be formed between borehole 56's surface and ball chock 22, between borehole 56's surface and cam chock 40, and between ball chock 22 and cam chock 40. Thus, the harder loop 12 is pulled upon by the weight of a user or the suspension of gear, the more securely borehole-engaging apparatus 10 lodges in borehole 56.

Removal of borehole-engaging apparatus 10 is simple and can be accomplished in several ways, as will be understood by those familiar with the use of such devices. In most cases, it will be sufficient just to grasp distally-projecting tether 14 close to where it enters borehole 56 and to apply a side-to-side wiggling motion thereto. This should dislodge ball chock 22 from its position where it is wedged between cam chock 40 and the surface of borehole 56, and it should also dislodge cam chock 40 from its engagement with the surface of borehole 56. Then, finger pull bar 28 is drawn proximally against the bias of coil spring 54, while pushing loop 12 and thus ball chock 22 slightly distally. This reduces the combined effective width of ball and cam chocks 22 and 40 such that apparatus 10 may be withdrawn from borehole 56. Slight rotation of borehole-engaging apparatus 10 about its longitudinal axis may aid its withdrawal from borehole 56.

When apparatus 10 is more securely set or welded in place after bearing a heavy load, a second method for removal may be more appropriate. A thin, elongate punch, pick, file, probe or other long, narrow, rigid member is simply inserted into borehole 56 beside tether 14, and it is set firmly against the proximal-most surface of ball chock 22 able to be reached. Then, just a light distally-directed tap on the rigid member will drive ball chock 22 distally and out of engagement with the wall of borehole 56 and the trough of cam chock 40. Once dislodged, finger pull bar 28 is drawn proximally, and apparatus 10 is removed from borehole 56.

Yet a third alternative approach to terminating the camming action of ball chock 22 and dislodging apparatus 10 from borehole 56 is to give a quick jerk or tap on finger pull bar 28 in a proximal direction.

It should be noted that it is very beneficial to the operation of apparatus 10 if chock operator cable 36 is resilient, yet shape-retaining, tending to spring back toward a linear posture after being deformed. This property is important as it tends to keep cam chock 40 close against the side of ball chock 22 as cam chock 40 moves to and fro laterally past ball chock 22. This is best illustrated by comparison of FIGS. 2, 3 and 11 with FIG. 10. When coil spring 54 is fully extended and uncompressed, and finger pull bar 28 is in its distal-most position, ball chock 22 rests adjacent cam chock 40's thicker, proximal end. In this posture, shown in FIGS. 2, 3 and 11, chock operator cable 36 is bent slightly radially away from its own longitudinal axis, and away from the longitudinal axis of distally-projecting tether 14. However, the resilient, shape-retaining character of chock operator cable 36 tends to bias cam chock 40 against the side of ball chock 22 with some force. It should also be remembered that in this posture, the width, i.e. the diameter, of ball chock 22 and the thickness of that portion of cam chock 40 which lies laterally adjacent to ball chock 22, add up to a distance greater than the borehole's diameter. Thus, in this posture, the combined effective width of apparatus 10's chocks is too great to permit apparatus 10 to be inserted into the borehole 56 for which apparatus 10 is designed. But, chocks 22 and 40 are held close together by chock operator cable 36.

Then, as finger pull bar 28 is drawn in the proximal direction to the point where thin, distal edge 44 of cam chock 40 lies laterally adjacent to ball chock 22, the tendency of chock operator cable 36 to return to a linear posture keeps thin, distal edge 44 close against ball chock 22. This is shown in FIG. 10. With cam chock 40 drawn proximally as shown, the combined width of chocks 22 and 40 at apparatus 10's distal end becomes slightly less than borehole 56's diameter. And, with chock control cable 36 holding cam chock 40 flush against ball chock 22, the distal end of apparatus 10 is easily inserted into the opening of borehole 56 and driven deep into its interior. This requires only one hand of the user. As long as finger pull bar 28 is drawn proximally, apparatus 10 may be driven distally in borehole 56 without obstruction. Then, once finger pull bar 28 is released and loop 12 is tugged in a proximal direction, cam chock 40 and chock control cable 36 are again deflected radially away from ball chock 22 and distally-projecting tether 14.

The shape-retaining tendency of chock control cable 36 to seek a linear posture also comes into play in removal of apparatus 10 from borehole 56. Once ball chock 22 is tapped slightly in a distal direction or cam chock 40 is jerked proximally thus terminating ball chock 22's camming action, drawing finger pull bar 28 proximally draws cam chock 40 proximally and, at the same time, causes chock control cable 36 to draw cam chock 40 radially inward due to chock control cable 36's tendency to return to a linear posture. This permits the thicker, proximal portion of cam chock 40 to nest-in proximal to ball end 26, next to ball chock 22's collar 24. This is shown in FIG. 10. Cam chock 40 is thus retained in that position while apparatus 10 is withdrawn from borehole 56. This retention of cam chock 40 in a radially inward position reduces the likelihood that the edge between cam chock 40's proximal end face 42 and outer primary surface 46 will catch on the surface of borehole 56 as apparatus 10 is withdrawn therefrom.

The amount of force with which cam chock 40 bears against the side of ball chock 22 is adjustable in the construction of apparatus 10 by varying the length of small diameter sheath 52 and/or by varying the length of chock control cable 36 which projects therefrom. If only a short portion of the distal end of chock control cable 36, with cam chock 40 attached, projects from small diameter sheath 52, then cam chock 40 will bear strongly against ball chock 22. The thickness and resilience of the cable used in constructing chock control cable 36 may also be chosen to achieve the desired amount of force of cam chock 40 against ball chock 22.

One modification to ball chock 22 which may increase its ability to engage the wall of borehole 56 is to deform ball chock 22's spherical shape slightly, shaping its outermost lateral surface in the form of a hemicircumferential belt 58. Outer belt 58 has a generally hemicylindrical curved plane surface, and a semicircular cross-section of uniform radius throughout. This is illustrated in FIGS. 1, 2, 10 and 11, but is perhaps best shown in the enlargement of FIG. 3. Outer belt 58 is hemicylindrical about the longitudinal axis of borehole-engaging apparatus 10, and wraps around that portion of ball chock 22 farthest from cam chock 40. That is, outer belt 58 wraps around the surface of ball chock 22 which is closest to the wall of borehole 56. The width of outer belt 58, in a proximal-to-distal direction, will determine how much of the surface area of ball chock 22 will be in contact with the wall of borehole 56. Outer belt 58 preferably has a radius just slightly less than the radius of borehole 56, such that the two mate uniformly. More or less surface area contact between ball chock 22 and borehole 56 may be desired for different purposes. The preferred proximal-to-distal width for general purposes is approximately one-third of the proximal-to-distal length of ball chock 22. However, outer belt 58 widths from one-fifth to one-half the length of ball chock 22 are envisioned.

The addition of outer belt 58 to ball chock 22 is expected to increase the security of engagement of borehole-engaging apparatus 10 with boreholes in several types of material. For example, under sufficient camming force, the single-point contact of a spherical ball chock 22 may tend to crumble the inner surface of the borehole in some types of rock at the point of contact, causing borehole-engaging apparatus 10 to slip. Addition of outer belt 58 to ball chock 22 spreads the same camming force over a larger area and reduces the likelihood of the rock crumbling at the point of contact.

Outer belt 58 may also be beneficial for engaging smooth-surfaced boreholes in very hard material, such as steel. A greater area of contact with the borehole wall makes it much more likely that, if borehole-engaging apparatus 10 starts to slip, the slip will be arrested before borehole-engaging apparatus 10 is pulled all the way out of the borehole.

Although outer belt 58 needs only to wrap partially around ball chock 22, it is contemplated that better manufacturing efficiency may be achieved by simply wrapping such a belt around the entirety of the circumference of ball chock 22.

Another modification to ball chock 22 which may also be desirable is the addition of a flattened belt to the inner lateral surface thereof. This is best shown in FIG. 3. Hemicircumferential inner belt 60 is generally hemicylindrical, having a curved plane surface and a semicircular cross-section of uniform radius throughout. However, inner belt 60 is not directly opposed to outer belt 58 on ball chock 22. Inner belt 60 is, instead, hemicylindrical about an axis parallel to the axis of the trough of inner primary surface 48, that axis being offset from the axis of apparatus 10, i.e. the axis about which outer belt 58 is formed. That is, inner belt 60's plane is offset from and nonparallel to the longitudinal axis of apparatus 10. The axis of apparatus 10 and of inner belt 60 converge toward the distal end of apparatus 10. The number of degrees of offset between apparatus 10's axis and the axis of inner belt 60 should be the same number of degrees of offset between the longitudinal axes of cylindrical inner and outer primary surfaces 48 and 46 of cam chock 40. Thus, in the preferred embodiment, an offset of approximately 8 to 9 degrees is employed.

Cylindrical inner belt 60 is shaped and positioned such that its curved, planar surface nests flush in the trough of cam chock 40's inner primary surface 48. The angles of the surfaces of cam chock 40's trough and inner belt 60 cooperate such that when ball chock 22 is nested in cam chock 40's trough, and ball chock 22 and cam chock 40 are moved to and fro axially and, simultaneously, laterally past one another, the cylindrical surface of outer belt 58 remains parallel to the cylindrical inner surface of borehole 56. Thus, as ball chock 22 is drawn along the trough of cam chock 40 to a point where the combined width of ball chock 22 and the thickness of that portion of cam chock 40 which lies directly lateral to ball chock 22 equal borehole 56's diameter, the entire surface of outer belt 50 should, at once, engage the inner surface of borehole 56.

The width of inner belt 60, in a proximal-to-distal direction along its own axis, will determine how much of the surface area of ball chock 22 will be in contact with the trough of cam chock 40. More or less surface area contact between ball chock 22 and cam chock 40 may be desired for different purposes. However, the preferred proximal-to-distal width of inner belt 60 for general purposes is approximately one-half the proximal-to-distal length of inner belt 60's longitudinal axis through ball chock 22. However, inner belt 60 widths from one-fifth to three-quarters the length of inner belt 60's longitudinal axis are envisioned.

The foregoing detailed disclosure of the inventive borehole-engaging apparatus 10 is considered as only illustrative of the preferred embodiment of, and not a limitation upon the scope of, the invention. Those skilled in the art will envision many other possible variations of the structure disclosed herein that nevertheless fall within the scope of the following claims.

And, alternative uses for this inventive apparatus may later be realized. Accordingly, the scope of the invention should be determined with reference to the appended claims, and not by the examples which have herein been given.

What is claimed is:

1. Apparatus for engaging a borehole, comprising:

a. a generally spherical first chock portion;

b. a wedge-shaped second chock portion;

c. a longitudinal channel in a surface of said second chock portion; and, d. means for moving said first chock portion axially, lateral to said second chock portion.

2. The apparatus of claim 1, further including means for moving said second chock portion axially, lateral to said first chock portion.

3. The apparatus of claim 2, wherein said second chock portion moving means is affixed to a thicker end of said second chock portion.

4. The apparatus of claim 1, wherein said second chock portion includes an outer primary surface which is cylindrically convex and adapted to seat flush against the wall of a borehole.

5. The apparatus of claim 1, wherein said second chock portion includes an inner primary surface, said longitudinal channel being disposed in said inner primary surface and shaped as a concave, inclined trough.

6. The apparatus of claim 1, wherein the axis of said longitudinal channel in said surface of said wedge-shaped second chock portion is disposed at a sufficient angle to an opposed surface of said wedge-shaped second chock portion to cause the combined width of said first and second chock portions to become greater as said first chock portion is moved in said longitudinal channel toward a thicker end of said second chock portion.

7. The apparatus of claim 1, wherein said wedge-shaped second chock portion includes an outer primary surface and an inner primary surface, said outer primary surface being cylindrically convex and adapted to seat flush against the wall of a borehole, and said longitudinal channel being disposed in said inner primary surface.

8. The apparatus of claim 7, wherein the axis of said longitudinal channel is disposed at a sufficient angle to the longitudinal axis of said cylindrically convex outer primary surface to cause the combined width of said first and second chock portions to be adapted to become greater than the width of a borehole as said first chock portion is moved in said longitudinal channel toward a thicker end of said second chock portion.

9. The apparatus of claim 1, wherein the sum of the diameter of said first chock portion and the thickness of a first, thinner end of said second chock portion is adapted to be less than the diameter of a borehole, and wherein the sum of the diameter of said first chock portion and the thickness of a second, thicker end of said second chock portion is adapted to be greater than the diameter of a borehole.

10. The apparatus of claim 1, wherein said generally spherical first chock portion includes a belt portion having a curved plane surface.

11. The apparatus of claim 10, wherein when said first chock portion is seated in said longitudinal channel of said second chock portion, said belt portion of said first chock portion is disposed on that face of said first chock portion farthest from said second chock portion.

12. The apparatus of claim 11, wherein said second chock portion includes a cylindrically-convex outer surface, and wherein said belt portion of said first chock portion has a radius slightly smaller than the radius of said second chock portion's cylindrically-convex outer surface.

13. The apparatus of claim 1, wherein said generally spherical first chock portion includes a hemicylindrical belt portion having a curved plane surface substantially parallel to the axis of said longitudinal channel.

14. The apparatus of claim 1, further including means for connecting a workpiece securely to said first chock portion.

15. The apparatus of claim 13, wherein said connecting means comprises a tether projecting from said first chock portion.

16. The apparatus of claim 13, wherein said connecting means includes a terminal loop.

17. The apparatus of claim 1, wherein said second chock portion includes a cylindrically-convex outer surface, and wherein the radius of said first chock portion is slightly smaller than the radius of said second chock portion's cylindrically-convex outer surface.

18. Apparatus for engaging a generally cylindrical borehole, comprising:

a. a first chock portion, said first chock portion being generally spherical;

b. a second chock portion lateral to said first chock portion, said second chock portion being shaped as an inclined trough and having first and second ends;

c. means for moving said second chock portion axially such that said first chock portion is, selectively, closer to said second chock portion's first end, or closer to said second chock portion's second end.

19. Apparatus for engaging a generally cylindrical borehole in solid receiving material, comprising:

a. a first chock portion, said first chock portion being generally spherical;

b. a second chock portion, said second chock portion being a trough-shaped wedge, the outer surface thereof being generally hemicylindrical and dimensioned to seat flush against an inner surface of a borehole, the inner trough surface of said second chock portion having a cross-section comprising a portion of a circular arc of a radius slightly larger than the radius of said spherical first chock portion, the longitudinal axis of said inner trough surface being coplanar with the longitudinal axis of said outer hemicylindrical surface, but offset at a small angle to said axis of said outer surface such that said second chock portion is thinner at a first end and thicker at a second end;

c. means for moving said first chock portion axially in a borehole; and, d. means for moving said second chock portion axially in a borehole.

20. Apparatus for engaging a borehole in solid receiving material, the borehole having a generally circular cross-section and a generally uniform diameter, comprising:

a. a first chock portion, said first chock portion being generally spherical;

b. a second chock portion, said second chock portion being wedge-shaped and comprising:

i. a first, thinner end;

ii. a second, thicker end;

iii. an outer, first primary surface, said first primary surface being cylindrically convex, and adapted to seat flush against the wall of a borehole;

iv. an inner, second primary surface, said second primary surface shaped as a concave, inclined trough dimensioned to permit said spherical first chock portion to slide freely therewithin;

c. means for moving said first chock portion axially in a borehole; and, d. means for moving said second chock portion axially in a borehole.

* * * * *